US005605604A

United States Patent [19]

Dillner et al.

[11] Patent Number: 5,605,604

[45] Date of Patent: Feb. 25, 1997

[54] METHOD OF REDUCING THE RESIN CONTENT IN SULFITE PULP

[75] Inventors: Bjorn Dillner; Hans Arne; Goran Tidstam, all of Saffle, Sweden

[73] Assignee: Kvaerner Pulping Aktiebolag, Karlstad, Sweden

[21] Appl. No.: 389,693

[22] Filed: Feb. 14, 1995

[30] Foreign Application Priority Data

Mar. 4, 1994 [SE] Sweden ..... 9400738

[51] Int. Cl.[6] ..... D21C 9/153

[52] U.S. Cl. ..... 162/65

[58] Field of Search ..... 162/25, 26, 65, 162/86, 57

[56] References Cited

U.S. PATENT DOCUMENTS 4,259,150 3/1981 Prough ..... 162/65 X
4,922,989 5/1990 Backlund et al. ..... 162/57 X

FOREIGN PATENT DOCUMENTS 1162358 2/1984 Canada ..... 162/65
3034042 8/1985 Germany .
404705 10/1978 Sweden .
267329 7/1970 U.S.S.R. ..... 162/65

OTHER PUBLICATIONS

Paperi JA PUU, Vol. 10, 1987, Nic. Soteland, Georg Carlberg, "Environmentally Acceptable Bleaching of Sulphite Pulp and Hardwood Kraft Pulp", p. 832–p. 838, see p. 834, col. 1, line 6–line 10, figure 4.

*Primary Examiner*—Arthur L. Corbin
*Attorney, Agent, or Firm*—Cushman Darby & Cushman IP Group of Pillsbury Madison & Sutro LLP

[57] ABSTRACT

Provided is a method for reducing resin content in sulfite pulp, in an ozone bleaching process where the sulfite pulp is bleached using ozone, at a pulp concentration of about 6 to about 14% by weight, and at a pH of less than about 7. The process includes the steps of alkalizing the sulfite pulp to a pH of greater than about 7 after ozone bleaching and then mechanically processing the sulfite pulp to press resin out of the sulfite pulp.

20 Claims, No Drawings

METHOD OF REDUCING THE RESIN CONTENT IN SULFITE PULP

BACKGROUND OF THE INVENTION

1. Field of the Invention

The present invention relates to a method for reducing the resin content in pulp produced by acidic decomposition during sulfite pulp cooking, and more particularly, to a method reducing the resin content in pulp produced by acidic decomposition during a sulfite pulp cooking step in an ozone bleaching process.

2. Description of Related Art

In order to meet the growing demand for paper pulp which has been produced entirely without bleaching using chlorine-containing chemicals, more and more paper pulp industries are becoming interested in the possibility of bleaching with ozone. Ozone is a very reactive chemical which has other effects in the process in addition to that which is primarily intended.

As is well known, the raw wood material which is used for producing paper pulp contains hemicellulose, lignin and extractive matter in addition to the sought-after cellulose. Of these substances, it is undesirable to have lignin and extractive matter in the final paper pulp product if the latter is to be of high quality. It can be said that the real purpose of cooking and delignification is to remove lignin and extractive matter from the chipping pieces so that the cellulose can be exposed. The release of extractive matter presents varying degrees of difficulty depending on the type of wood and on the pulp process. It is, for example, easier to prepare resin-free pulp from pine than from spruce, despite the fact that the extractive matter in pine wood is, in principle, more difficult to dissolve than that in spruce wood. This is due to the fact that, in its structure, pine wood has larger communication channels from the parenchymal cells, which contain the extractive matter, thereby facilitating transport from these cells.

The choice of process is also of great importance. Chemically prepared pulp can be subdivided into sulphate pulp, sulphite pulp and dissolving pulp. Sulphate pulp is produced by alkaline decomposition, which results in the extractive-matter content of the raw wood material not posing any direct problem, because the resin dissolves in the alkaline cooking liquid. When preparing sulfite pulp by acidic decomposition, the problem of separating off the resin is entirely different. The extractive matter is not dissolved so readily in the acidic cooking liquid, but instead tends to remain in the pulp. The resin then clings to the wire cloth when the paper is itself being manufactured, leading to holes being produced in the paper. Due to this, paper manufacturing has to be halted a couple of times a day in order to blow resin from the wire cloth. This leads to large losses in production.

When the pulp is used to manufacture food-stuff wrapping, for example so-called grease-proof paper, the resin also gives an undesirable taste to the paper/carton, which is also a very big disadvantage.

In principle, the preparation of dissolved pulp can be categorized separately, despite the fact that both sulphate pulp and sulfite pulp processes can be used. The cooking is carried out to very low yield, because the aim is that only pure cellulose, composed entirely of glucose, should remain in the pulp. Elimination of the resin is also of importance when preparing dissolved pulp. Methods which are used include, for example, storing of the chippings to permit so-called maturation of the resin, extraction by alkali with or without the addition of surfactants, and replacement of chlorine by chlorine dioxide in the pulp bleaching.

Swedish Patent 424884 (and 418628) of Mo and Domsj ö AB, has proposed a process for decreasing the content of resin in cellulose pulps. According to this method, which is preferentially based on unbleached pulp, dewatering first takes place, where appropriate in several stages, to 15–35% by weight. Thereafter, alkali is added so that a pH of greater than 11 is obtained, and the pulp is processed mechanically in an apparatus having screws which rotate relative to each other. After this, the pulp is conveyed, using a pump, worm conveyor or belt conveyor, for example, to a tower or similar container, for further reaction with added chemicals. The dwell time for this stage of the reaction should be between 6 minutes and 5 hours. Thereafter, the pulp is washed in order to remove the resin which has been released.

While it is true that a substantial reduction in the resin content of the pulp can be achieved by using this method, the disadvantage is that the process is elaborate and requires a relatively extensive array of apparatus.

It can therefore be stated that there has hitherto been no simple method for removing resin from pulp, something which has been the curse of sulfite industries.

SUMMARY OF THE INVENTION

An object of the invention is to provide a simple method for reducing the resin content in pulp that is produced by acidic decomposition in sulfite pulp cooking step in an ozone bleaching process.

It has now been found, very surprisingly, that a bleaching ozone treatment of sulfite pulp with a view to reducing the kappa number also results in a significant decrease of the resin content as a consequence of oxidation of the latter. A dramatic reduction in the resin content can be brought about especially in association with alkalization and mechanical processing of the pulp after the ozone stage.

DETAILED DESCRIPTION OF THE PREFERRED EMBODIMENTS

The invention relates to a method for reducing a resin content in sulfite pulp, in an ozone bleaching process where the sulfite pulp is bleached using ozone, at a pulp concentration of about 6 to about 14% by weight, and at a pH of less than about 7. The method comprises the steps of alkalizing the sulfite pulp to a pH of greater than about 7 after ozone bleaching and then mechanically processing the sulfite pulp. The mechanical processing exhibits a massaging effect on the pulp that helps to press the resin out of the pulp.

The ozone stage is preferably carried out at a pH of about 2 to about 3. Preferably, in the ozone stage, the pressure on the pulp is at least about 8 bar, the temperature is at most about 60° C., more preferably about 20° to about 40° C., and the pulp concentration is about 8 to about 12% by weight.

Preferably, the alkalization is carried out to a pH of greater than about 9, and more preferably greater than about 10. The alkalization can be carried out, for example, in association with a dilution of the pulp concentration to about 1 to about 5% by weight. NaOH is preferably used to bring about the desired alkalization after the ozone stage.

In addition to a screw press, the mechanical processing of the pulp can be carried out, for example, in a washing press or other apparatus which effects satisfactory processing of the pulp. The mechanical processing is preferably carried out in association with a thickening of the pulp to a pulp concentration exceeding about 20% by weight, more preferably greater than about 25% by weight, and most preferably greater than about 30% by weight.

A part of the filtrate from the thickening, for example, can used for the dilution of the pulp in the alkalization stage. Preferably, resin is separated from the filtrate before adding the filtrate to the pulp in alkalization stage. The filtrate can be, for example, heated in a heat exchanger before adding it to the pulp in the alkalization stage to adjust the temperature of the pulp in the alkalization stage. Remaining parts of the filtrate from the thickening can also be treated in order to remove the liberated resin from the liquor and used at some other point in the ozone bleaching process.

Preferably, the pH of the pulp should not be allowed to fall below about 7 between the alkalization step and the mechanical processing step to ensure that the resin remains in solution.

In a preferred embodiment, the ozone treatment takes place at a pH of about 2 to about 3, a pulp concentration of between about 8 to about 12% by weight, a pressure of about 10 bar, and a temperature of about 30 C. The ozone gas is admixed in a first mixer and the mixing effect is subsequently amplified by the pulp having to pass through one or more additional mixers without any further gas being admixed. After the last mixer in the ozone stage, the pulp is conveyed via a pipe conduit to a blow tank. There is no need for a special reactor to achieve dwell time. In the blow tank, the pulp is alkalized to a pH of greater than about 10. At this point, preferably, the temperature is higher than that in the ozone stage, because this has a favorable effect on resin separation. The pulp is subsequently processed mechanically in a screw press and simultaneously thickened to a dry matter content of greater than about 30% by weight. The pH of the pulp should not fall below about 7 between the blow tank and the mechanical processing to ensure that the resin remains in solution.

Using the methods described here, unwanted resin can be removed from sulfite pulp in a simple and effective manner, thereby considerably facilitating the manufacture of the paper and avoiding problems with the paper having an undesirable taste. If the sulfite pulp industry desires to use the ever more popular bleaching chemical ozone in order to comply with the public demand for bleaching which is completely free of chlorine, the only supplementary apparatus which is required to practice the present invention is a mechanical processor, for example a screw press.

Experiments have indicated that the resin content is halved from an initial value of about 1.2% by weight down to a content of about 0.6% by weight after ozone treatment, alkalization and mechanical processing in association with thickening.

While the invention has been described in detail and with reference to specific embodiments thereof, it will be apparent to one of ordinary skill in the art that various changes and modifications can be made therein with departing from the spirit and scope thereof. Thus, it will be readily evident to the person of ordinary skill in the art, for example, that the process stages which have been described do not need to be carried out precisely one after the other, but preferably only in the order disclosed herein, and that the equipment for the process does not necessarily have to be that which has been described herein, but other equipment can also be used which is suitable for executing the method.

We claim:

1. A method for reducing the resin content in sulfite pulp, in an ozone bleaching process wherein the sulfite pulp is bleached using ozone, at a pulp concentration of about 6 to about 14% by weight, and at a Ph of less than about 7, the method consisting essentially of the steps of:

alkalizing the sulfite pulp to a pH of greater than about 7 after said ozone bleaching; and then mechanically processing the sulfite pulp to press resin out of the sulfite pulp and to thicken the sulfite pulp to a pulp concentration exceeding about 20% by weight.

2. A method according to claim 1, wherein the pH of the sulfite pulp is increased to pH greater than about 9 during the alkalizing step.

3. A method according to claim 1, wherein the pH of the sulfite pulp is increased to pH greater than about 10 during the alkalizing step.

4. A method according to claim 1, wherein the mechanical processing step is carried out using a screw press.

5. A method of preparing bleached sulfite pulp having a reduced resin content, the method consisting essentially of the steps of:

bleaching a sulfite pulp using ozone, at a pulp concentration of about 6 to about 14% by weight, and at a pH of less than about 7;

alkalizing the sulfite pulp to a pH of greater than about 7 after the ozone bleaching step; and then mechanically processing the sulfite pulp to press resin out of the sulfite pulp and to thicken the sulfite pulp to a pulp concentration exceeding about 20% by weight.

6. A method according to claim 5, wherein during the bleaching step the pulp concentration is about 8 to about 13% by weight, and the pH is about 2 to about 3.

7. A method according to claim 5, wherein the pH of the sulfite pulp is increased to pH greater than about 10 during the alkalizing step.

8. A method according to claim 5, wherein the mechanical processing step is carried out using a screw press.

9. A method according to claim 5, wherein the ozone bleaching step is carried out at a temperature less than about 60° C. and under a pressure of at least about 8 bar.

10. A method according to claim 9, wherein the ozone bleaching step is carried out at a temperature of about 20° to about 40° C.

11. A method according to claim 5, wherein the step of mechanical processing step further comprises removing filtrate containing resin whereby the sulfite pulp is thickened to a pulp concentration exceeding about 25% by weight.

12. A method according to claim 5, wherein the step of mechanical processing step further comprises removing filtrate containing resin whereby the sulfite pulp is thickened to a pulp concentration exceeding about 30% by weight.

13. A method according to claim 5, further comprising the step of diluting the sulfite pulp to a concentration of about 1 to about 5% by weight during the alkalizing step.

14. A method according to claim 5, further comprising the step of diluting the sulfite pulp to a concentration of about 1 to about 5% by weight, during the alkalizing step, using filtrate from the mechanical processing step which has first been treated to remove the resin.

15. A method according to claim 14, wherein the temperature in the step of alkalizing the sulfite pulp is effected by at least a part of the filtrate which is heated and conveyed to the alkalization stage.

16. A method according to claim 5, wherein the temperature during the step of alkalizing the sulfite pulp is maintained at a higher level than the temperature in the ozone step.

17. A method according to claim 5, wherein the pH is not permitted to fall below about 7 between the step of alkalizing the sulfite pulp and the mechanical processing step.

18. A method according to claim 5, wherein the step of alkalizing the sulfite pulp is carried out using NaOH in a blow tank.

19. A method according to claim 18, wherein the ozone bleaching step takes place in a first mixer, and further mixing takes place in one or more additional mixers, and the sulfite pulp, after the last additional mixer, is conveyed directly to the blow tank via a pipe conduit.

20. A method according to claim 5, wherein the pH of the sulfite pulp is maintained above about 7 between the step of alkalizing the sulfite pulp and the mechanical processing step to ensure that resin dissolved in solution during the step of alkalizing the sulfite pulp remains in solution.

* * * * *